US008753233B2

(12) United States Patent
Lay

(10) Patent No.: US 8,753,233 B2
(45) Date of Patent: Jun. 17, 2014

(54) SWING TRAINER

(76) Inventor: William Coleman Lay, Saint George, UT (US)

( * ) Notice: Subject to any disclaimer, the term of this patent is extended or adjusted under 35 U.S.C. 154(b) by 269 days.

(21) Appl. No.: 13/034,615

(22) Filed: Feb. 24, 2011

(65) Prior Publication Data

US 2012/0220395 A1 Aug. 30, 2012

(51) Int. Cl.
*A63B 69/00* (2006.01)

(52) U.S. Cl.
CPC ..... *A63B 69/0075* (2013.01); *A63B 2209/02* (2013.01); *A63B 2069/0008* (2013.01)
USPC ..... 473/451; 473/423; 473/458

(58) Field of Classification Search
USPC ..... 473/422, 417, 429, 457, 437, 458, 450, 473/423, 424, 430, 451
See application file for complete search history.

(56) References Cited

U.S. PATENT DOCUMENTS

| | | | | | |
|---|---|---|---|---|---|
| 1,962,087 | A * | 6/1934 | Cone | 473/429 |
| 2,272,765 | A * | 2/1942 | Beeson et al. | 473/417 |
| 2,617,676 | A * | 11/1952 | Kinney, Jr. | 294/31.2 |
| 2,884,250 | A * | 4/1959 | Patterson | 473/423 |
| 4,022,467 | A * | 5/1977 | Ruess | 473/464 |
| 4,042,237 | A * | 8/1977 | Moraru | 473/429 |
| 4,277,063 | A * | 7/1981 | Perrone et al. | 473/538 |
| 4,407,503 | A * | 10/1983 | Nishizawa | 473/149 |
| 4,508,339 | A * | 4/1985 | Llewellyn | 473/429 |
| 4,513,965 | A * | 4/1985 | Aschermann | 473/458 |
| 4,697,377 | A * | 10/1987 | Martin | 43/23 |
| 4,938,478 | A * | 7/1990 | Lay | 473/423 |
| 5,035,424 | A * | 7/1991 | Liao | 473/423 |
| 5,230,506 | A * | 7/1993 | Cipriano et al. | 473/424 |
| 5,467,978 | A * | 11/1995 | Paluch | 473/429 |
| 5,492,321 | A * | 2/1996 | Cipriano | 473/424 |
| 5,601,286 | A * | 2/1997 | Fierbaugh | 473/429 |
| 6,299,557 | B1 * | 10/2001 | Mueller | 473/553 |
| 6,390,939 | B1 * | 5/2002 | Palacios | 473/422 |
| 6,435,989 | B1 * | 8/2002 | Grubman | 473/422 |
| 6,458,037 | B1 * | 10/2002 | Dixon, Jr. | 473/219 |
| 6,786,841 | B1 * | 9/2004 | Dixon | 473/451 |
| 7,226,373 | B2 * | 6/2007 | Arenas | 473/417 |
| 7,444,777 | B2 * | 11/2008 | Keys et al. | 43/23 |
| D585,644 | S * | 2/2009 | Guilbault | D3/257 |
| 7,775,911 | B2 * | 8/2010 | Zappel et al. | 473/422 |
| 7,785,211 | B2 * | 8/2010 | Hackenberg | 473/256 |
| 8,128,516 | B2 * | 3/2012 | Pan et al. | 473/427 |
| 8,147,357 | B1 * | 4/2012 | Nichols | 473/453 |
| 8,337,337 | B2 * | 12/2012 | Lay | 473/417 |
| 2004/0224804 | A1 * | 11/2004 | Estape et al. | 473/568 |
| 2010/0130313 | A1 * | 5/2010 | Bastian | 473/457 |
| 2010/0304900 | A1 * | 12/2010 | Gu | 473/419 |

* cited by examiner

*Primary Examiner* — Mitra Aryanpour

(57) ABSTRACT

The present invention provides for the first time a swing trainer having a sheath with a core end and a protective end, the core end of the sheath has a cover attached.

42 Claims, 12 Drawing Sheets

SWING TRAINER

BACKGROUND

1. Field of Invention

The present invention relates to sports products and more particularly to a swing trainer used by sports players for hitting balls and other objects.

2. Description of Prior Art

In many sports, one of the most difficult skills to master is hitting. First, the hitter must be able to coordinate the swing of a bat, club, racquet, or stick while making contact with an object such as a ball, puck, or other sports projectile. Once this skill is mastered, the hitter must next learn to make good contact with the object at various locations. In some cases the hitter must also learn to hit the object as it travels at velocities over 100 mph.

To develop good hitting skills, a player, trainer, or coach may use a variety of hitting devices. In baseball, softball, tennis, and other sports requiring a player to hit an object, a swing trainer is sometimes used.

In regards to the present invention, there are two popular types of swing trainers.

One type of swing trainer is called a batting stick. A batting stick is a swing trainer having a molded piece of plastic formed in the shape of a ball on one end, a flexible fiberglass rod in the center, and a molded handle on the opposite end.

In use, one person holds the batting stick in his or her hand, while a hitter swings at the simulated molded ball. Once hit, the holder brings the batting stick to a stop and repositions the molded ball back in the hitting zone for the hitter to hit again. The batting stick allows a hitter to get in many hits in a small amount of time, eliminates the need to chase a ball, allows the hitter to practice hitting at home, and is quite inexpensive.

Another type of swing trainer is called a solo swing trainer. A solo swing trainer functions like a batting stick; however, there is no need for a second person to hold the batting stick since the solo swing trainer holds the batting stick for the hitter. Once a hitter hits the batting stick, the solo hitter has a resistance member to return the batting stick back to its original position.

The benefit of the solo swing trainer is the hitter is not dependent on another person to hold the batting stick. This allows the hitter freedom to hit. Just like the batting stick, the solo trainer allows a hitter to get in many hits in a small amount of time, eliminates the need to chase a ball, allows the hitter to practice hitting at home. However, the solo trainer is more expensive than the batting stick.

There are many known problems with the batting stick listed above. First, since a batter is hitting a ball molded to a fiberglass rod, the ball wants to fly off the fiberglass rod. Because of this problem, current batting sticks have been designed with a sheath that has a core end and a protective end. The core end looks like a ball and the protective end is molded down the fiberglass rod about 9". The molded protective end adds more gripping surface to the fiberglass rod to help keep the molded core attached. In addition, the molded protective end also provides protection from breaking the fiberglass rod when hit by a bat, racquet or the like.

The problem with the solo swing trainer is the batting stick wants to come unattached from the solo stand. Because of this problem, the batting stick does not have a handle designed for a human hand to hold, but has handle designed for a machine to hold. This makes it impossible for a person to remove the batting stick from the solo swing trainer and use it by itself at home, the ball field, or the court.

Another problem with the solo swing trainer is the base is very heavy and expensive to ship and use. The reason for this is the solo swing trainer must be able to withstand a hit ball without tipping over. Therefore a great deal of weight is required for stability and weight cost money in both material and shipping.

Another problem with both the batting stick and the solo swing trainer is sometimes the molded ball comes unattached from the fiberglass rod or the fiberglass rod breaks due to impact. This becomes a safety concern since an dislodged object can come in contact with a person or thing and cause damage.

Also, since the molded ball is a one piece molded construction, having a core end that looks like a ball and a protective end that creates additional gripping for the ball to stay attached to the fiberglass rod, no one has been able to attach a cover to the oblong sheath piece. This is because the 9" long protective end of the sheath keeps the cover from attaching to the core end.

Another problem with the two current designs is the material used to mold the ball can't be shaped to look like a baseball or softball since the transition from the protective end to the core end needs to be smooth since sharp corners cause weak points in the molded ball. This weak point will make it almost impossible for the ball to stay on the fiberglass rod when hit.

Because of this, current batting sticks have a large fillet/transition radius transitioning from the protective end to the core end. This also causes the ball to look more like a knob than a real ball.

In addition, since the ball and the protective end are of an oblong molded construction, the protective end and the ball are of the same color. This makes it difficult for the human eye not to focus on both the ball and the protective end. One product in the market has recognized the problem of having the same color ball and protective end. Because of this, the product includes a separate cover sheath that is a different color. This cover sheath slides over the protective end of the molded sheath. However, the molded ball still does not look like a regulation ball since a real cover has not been attached to the core end of the sheath.

Because of these problems, I took one of the previously designed batting sticks, cut off the handle, and painted the protective end black. I then wrapped tape around the core end of the batting stick to build up the diameter of the core end. Once I did this, I then removed the thread from a cover of a regulation ball. I took the cover apart and cut a hole the size of the protective end, approximately 0.750" in diameter, in the vertical cover section of the cover. I then slid the fiberglass rod through the hole in the cover and sewed the cover on the batting stick.

After I did this, I tested the product and noticed the paint was chipping off the stem. This gave me the idea to mold the desired color into the sheath. In addition, the sheath's preferred color should contrast with the color of the cover.

The next step was finding a material that could be molded with a tighter transitional radius so the core end of the sheath could look more like a ball.

The next problem was to design a safety anchor in case the ball flew off the rod or broke when hit. I did this by sewing a nylon strap about 0.500" in diameter and about 9" in length on the cover of the ball. I then sewed a loop on the other end of the safety anchor.

To assemble, I slid the loop over the fiberglass rod until the loop hit the beginning of the protective end of the sheath. I then sewed the ball cover on the core end of the sheath.

I then designed a solo stand that would allow me to quickly attach and remove a batting stick made for the human hand, instead of one made to mount to a machine. This gave me the ability to provide a 2-in-1 swing trainer.

The new 2-in-1 swing trainer comes with a batting stick that can be used with another person, or alone with a solo stand. In one case the hitter can carry the batting stick in a bat bag and then take it out of the bat bag to warm up before a game with a friend. Then the hitter can come home later and quickly attach the batting stick to the solo stand and hit alone.

OBJECTS AND ADVANTAGES

Therefore, it is one object of the present invention to provide for the first time a swing trainer having a cover attached to the core end of the sheath.

It is another object of the present invention to provide for the first time a contrasting color sheath, wherein the color of the ball or core end contrasts with the color of the protective end of the sheath.

It is a further object of the present invention to provide for the first time a safety anchor for keeping the sheath safely attached to the swing trainer in case rod breaks or the sheath becomes removed from the rod.

It is still another object to provide a 2-in-1 swing trainer that can be used by two people as a batting stick and then quickly attached to a solo stand to be used alone.

It is yet another object to provide a solo stand that has a weight-fillable base to save production and shipping costs.

BRIEF SUMMARY OF INVENTION

In accordance with one embodiment, there is provided for the first time a swing trainer having a sheath with a core end and a protective end, the core end of the sheath has a cover attached.

Other features of the present invention will become apparent upon reading the following detailed description of embodiments of the invention, when taken in conjunction with the appended claims

BRIEF DESCRIPTION OF DRAWINGS

To further clarify the above and other advantages, and features of the present invention, a more particular description of the invention will be rendered by references to specific embodiments thereof, which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

REFERENCE NUMERALS OF DRAWINGS

| | | | |
|---|---|---|---|
| 20 | Swing Trainer | 22 | Sheath |
| 24 | Core End | 26 | Protective End |
| 28 | Sheath's Contrasting Color | 30 | Cover |
| 32 | Cover Hole | 34 | Safety Anchor |
| 36 | Safety Anchor Loop | 38 | Horizontal Cover Member |
| 40 | Vertical Cover Member | 42 | Seam Hole |
| 44 | Seam | 46 | Stem |
| 48 | Stem Cover | 50 | Proximal End |
| 52 | Distal End | 54 | Handle |
| 56 | Handle Anchor | 58 | Removable Handle Clamp |
| 60 | Holding Member | 62 | Latch Member |
| 64 | Structure Member | 66 | Connection Member |
| 68 | Support Member | 70 | Resistance Member |
| 72 | Height Member | 74 | Base |
| 76 | Base Opening | 78 | Base Seal |
| 80 | Securement Member | 82 | Flange |
| 84 | Barricade | 86 | Base Mount Member |
| 88 | Base Support Member | 90 | Handle Loop |
| 92 | Mounting Loop | 94 | Cradle Member |
| 96 | Threaded Knob | 98 | Threaded Nut |
| 100 | Batting Stick | 102 | Solo Stand |

PREFERRED EMBODIMENTS

Description

A swing trainer 20 is shown in several preferred embodiments as illustrated in FIGS. 1-33.

A sheath 22 is illustrated throughout the drawings but is specifically called out in FIGS. 1A, 1B, 2, 4B, 12, 13, 14, 15B, 15C, 17, 20, 21, 26.

A core end 24 of the sheath is illustrated throughout the drawings but is specifically called out in FIGS. 1A, 1B, 15B, 15C.

Figure 1A:
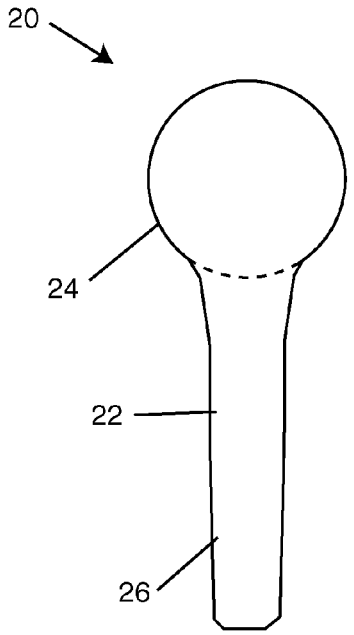
FIG. 1A is a perspective front view of a swing trainer embodiment illustrating a sheath that has a core end and a protective end.
Figure 1B:
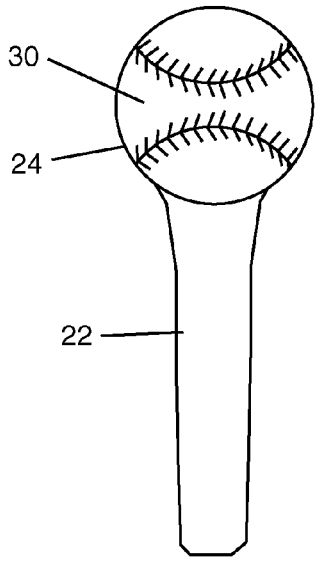
FIG. 1B is a perspective front view of a swing trainer embodiment illustrating a sheath with a cover on the core end.
Figure 15A:
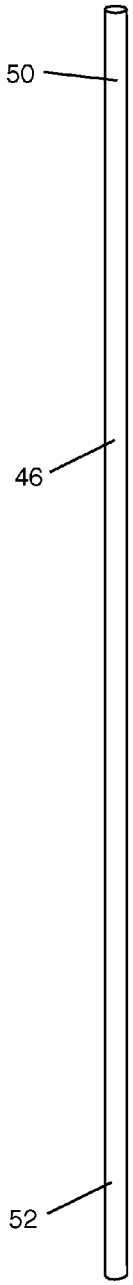
FIG. 15A is a perspective front view of a swing trainer embodiment illustrating a stem having a proximal end and a distal end.
Figure 15B:
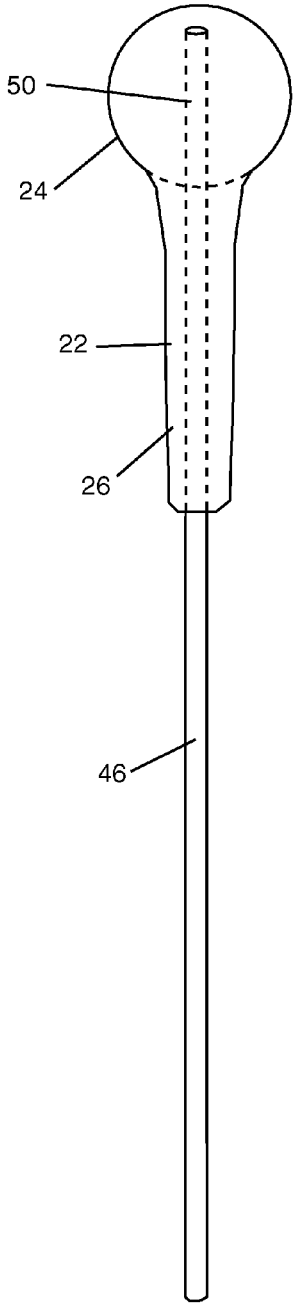
FIG. 15B is a perspective front view of a swing trainer embodiment illustrated in FIG. 15A further illustrating a sheath having a core end and a protective end. The sheath is attached to the proximal end of the stem.
Figure 15C:
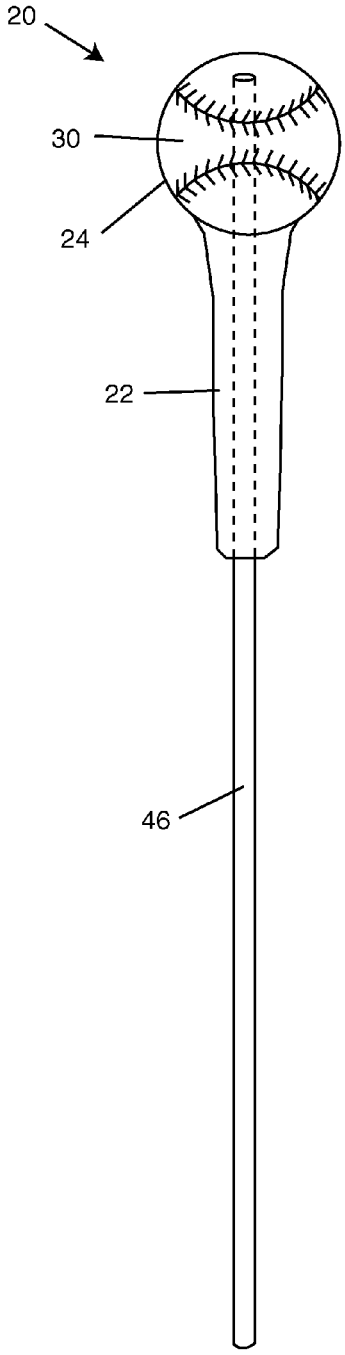
FIG. 15C is a perspective front view of a swing trainer embodiment illustrated in FIG. 15B further illustrating a cover attached to the core end of the sheath.
Figure 16:
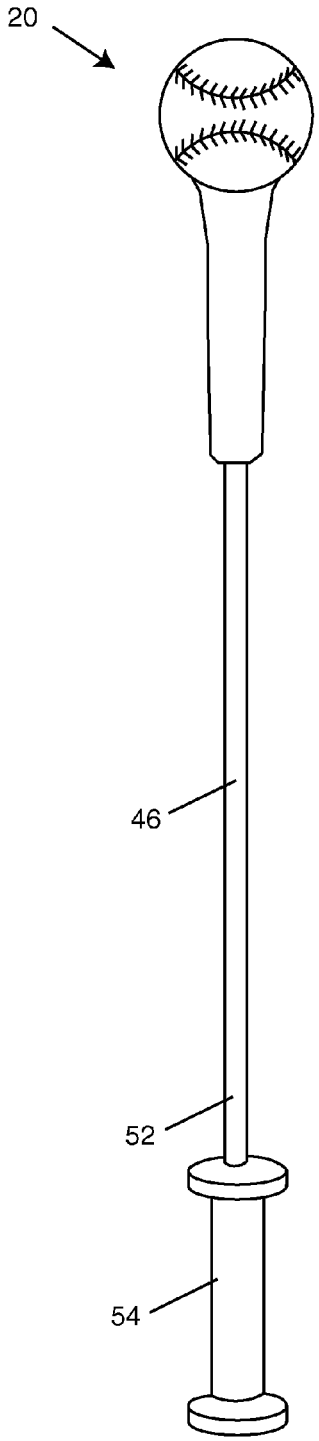
FIG. 16 is a perspective front view of a swing trainer embodiment illustrated in FIG. 15C further illustrating a handle attached to the distal end of the stem.
Figure 17:
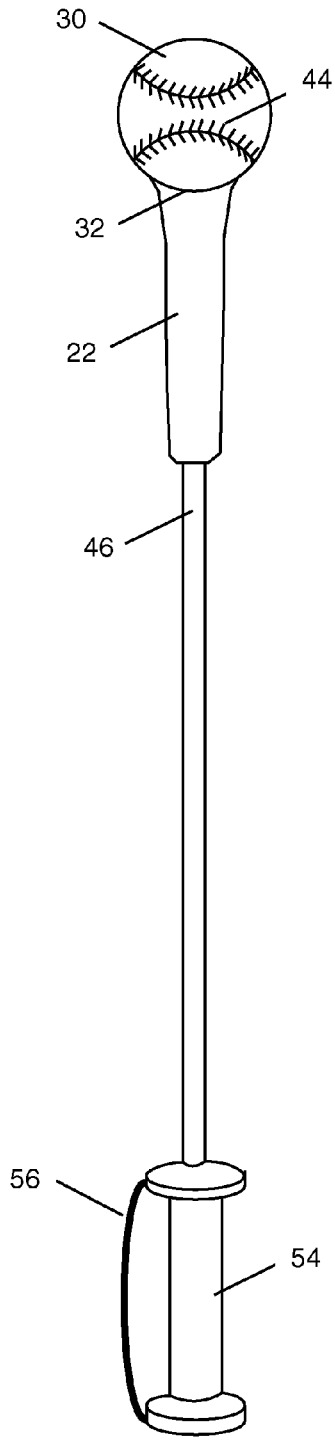
FIG. 17 is a perspective front view of a swing trainer embodiment illustrated in FIG. 16 further illustrating a handle anchor attached to the swing trainer.
Figure 18:
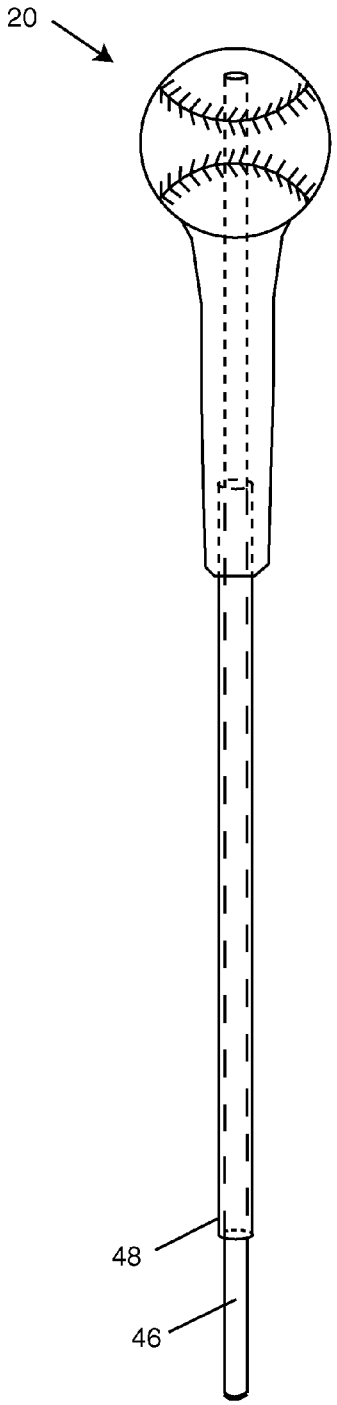
FIG. 18 is a perspective front view of a swing trainer embodiment illustrating a stem cover placed over the stem.
Figure 19:
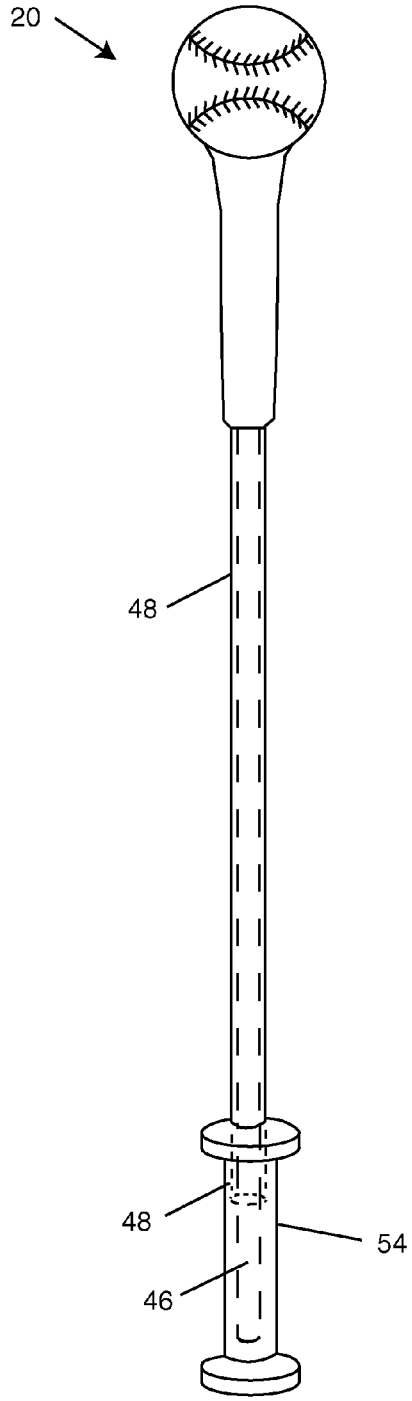
FIG. 19 is a perspective front view of a swing trainer embodiment illustrated in FIG. 18 further illustrating a handle attached to the stem and stem cover.
Figure 20:
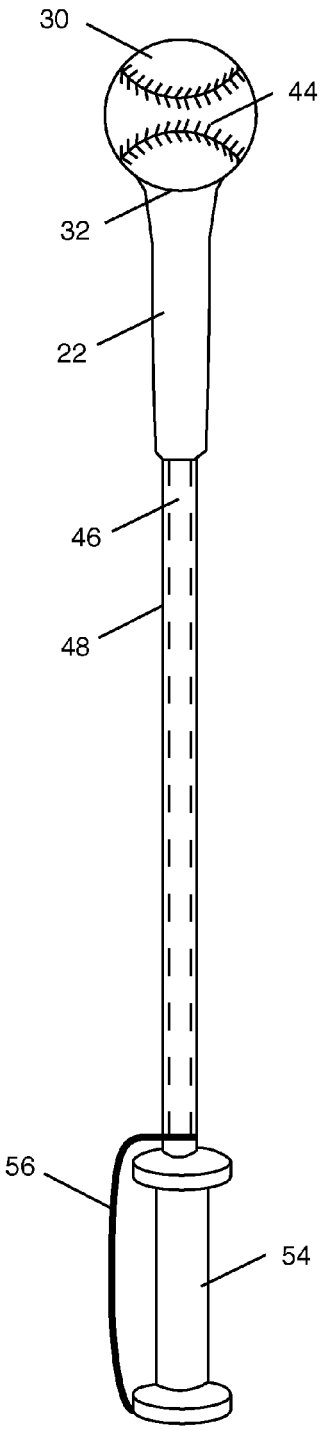
FIG. 20 is a perspective front view of a swing trainer embodiment illustrated in FIG. 19 further illustrating a handle anchor attached to the swing trainer. Additional illustrations of the cover, cover hole, seam, sheath, stem, stem cover, and handle are also provided.

A protective end 26 of the sheath is illustrated throughout the drawings but is specifically called out in FIGS. 1A, 15B.

Figure 2:
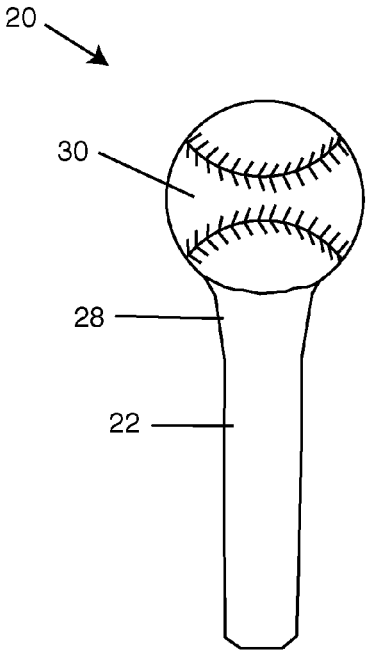
FIG. 2 is a perspective front view of a swing trainer embodiment illustrating a sheath having a contrasting color compared to the cover.
Figure 3:
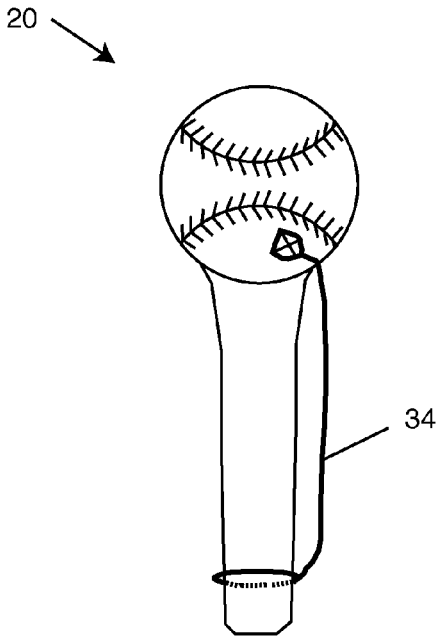
FIG. 3 is a perspective front view of a swing trainer embodiment illustrating a safety anchor attached to the cover and the sheath.

A sheath's contrasting color 28 is illustrated throughout the drawings but is specifically called out in FIG. 2.

The sheath 22, in one embodiment, is fabricated by molding a core end 24 and a protective end 26 out of a material such as skinned foam polyurethane. The inner foam portion makes the sheath 22 lightweight, soft when hit, and impact absorbent. The skin portion creates a durable exterior skin on the sheath 22. This skin acts as the structural strength to keep the inner foam intact when hit with a bat or other impact causing object.

In some cases, the core end 24 of the sheath 22 can be small in size like a golf ball, medium in size like a tennis ball or baseball, large in size like a softball, or any size that seems appropriate for this type of application.

In many instances, the core end 24 is fabricated in a larger configuration than the protective end 26 so a cover 30, or other object, can be attached to the sheath 22 without having the cover 30 come off when impacted by an object such as a bat.

Many times the protective end 26 of the sheath 22 acts as a protective cushion for an object, such as a stem 46, when the object is molded into the sheath 22. The protective end 26 of the sheath 22 can be longitudinal in shape and can measure from as little as 0.0625 inches in length to 4' or more in length if desired. In the current embodiment, the protective end 26 measures approximately 9" in length.

When a stem 46 is molded into the sheath 22, the protective end 26 acts to protect, cushion, and insulate the stem 46 from breakage caused by the impact of a bat or other impact causing object. The protective end 26 can measures any reasonable size in diameter. In the present embodiment, the sheath measures approximately 1.375" where the core end 24 meets the protective end 26 and tapers down at approximately 3" from the end of the protective end 26 to approximately 0.875" in diameter.

Another purpose of the protective end 26 is to keep the sheath 22 molded or attached to a stem 46 when impacted by an object such as a bat. The longitudinal length of the protective end 26 provides additional surface or gripping area for objects such as the stem 46 to hold onto, or attach to.

In one embodiment, the sheath 22 has a large radius from the protective end 26 to the core end 24. This large radius eliminates stress points and makes the sheath 22 stronger. The size of the radius depends on the structural strength of the skinned foam polyurethane or other sheath 22 material. The stronger the polyurethane or other material, the smaller the radius required to keep the sheath 22 from tearing of breaking.

The sheath's 22 color can be mixed into the skinned foam polyurethane before it is injected into the mold so the color can be a part of the skinned foam polyurethanes molecular structure. This keeps the color from coming off when hit with an impact causing object such as a bat.

The molded color can be any color desired; however, in one embodiment the color is molded black to keep the human eye from focusing on the sheath 22. This black color allows a white or contrasting colored cover 30, to attach to the core end 24 of the sheath 22. This contrasting color allows the human eye to focus more precisely on the cover 30 without being distracted by the sheath 22.

Other materials, sizes, dimensions, and processes can be used to fabricate the sheath 22. For example a sheath could be fabricated by hand pouring rubber, polyurethane, or any other suitable material into a mold. You can also inject certain materials into a mold with an injection molding machine.

A sheath 22 can also be machined into shape out of different types of materials such as rubber, cork, string, or any other suitable material for withstanding impact from a bat or other impact causing object. One important point is that the sheath 22 includes a core end 24 and a protective end 26.

In certain cases the core end 24 acts as a hitting target and a mounting pedestal for attaching a cover. Also in certain instances, the protective end 24 is longitudinal in shape and protects objects, such as a stem 46 from breaking because of bat or other impact causing object impact. The protective end 24 can also add additional holding or bonding strength when attaching the sheath 22 to the stem 46. An object, such as a stem 46, can be bonded more securely to the sheath 22 because the protective end 24 adds additional gripping area for the sheath 22

A cover 30 is illustrated throughout the drawings but is specifically called out in FIGS. 1A 1B, 2, 4A, 4B, 5, 6, 7, 8, 9, 10, 11, 12, 13, 14, 15C, 17, 20, 21.

A cover hole 32 is illustrated throughout the drawings but is specifically called out in FIGS. 4A, 4B, 6, 9, 10, 13, 14, 17, 20, 21.

Figure 5:
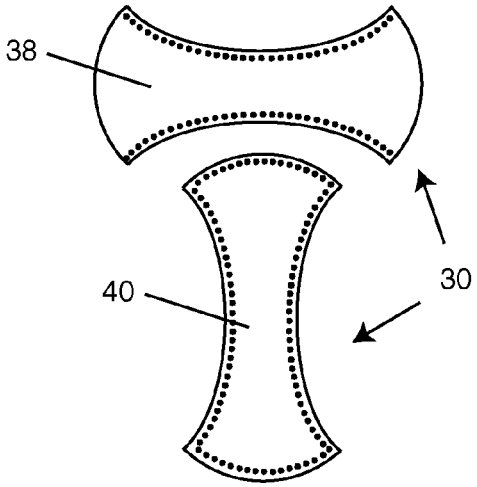
FIG. 5 is a perspective front view of a swing trainer embodiment illustrating two sections of the cover, a horizontal cover member and a vertical cover member.
Figure 6:
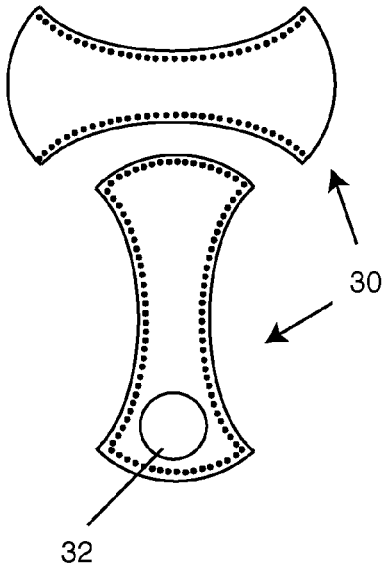
FIG. 6 is a perspective front view of a swing trainer embodiment illustrating a cover hole in the cover.
Figure 7:
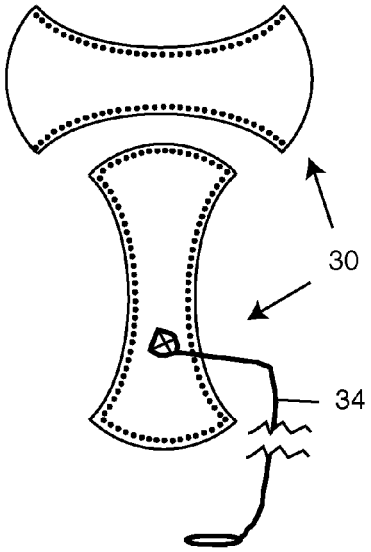
FIG. 7 is a perspective front view of a swing trainer embodiment illustrating a safety anchor attached to the cover.
Figure 12:
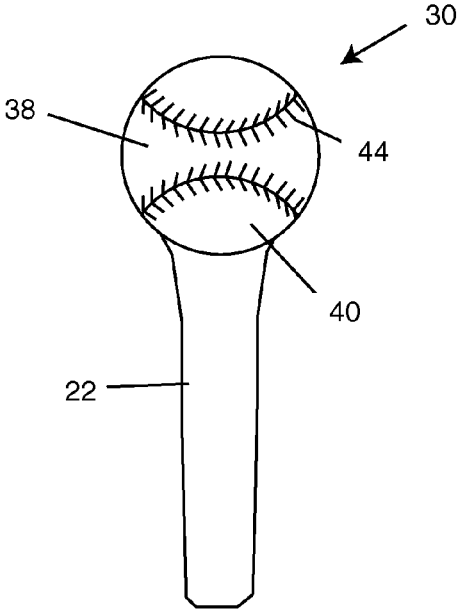
FIG. 12 is a perspective front view of a swing trainer embodiment illustrating an assembly of the cover and the sheath. The horizontal cover member and the vertical cover member are connected together with a seam.
Figure 13:
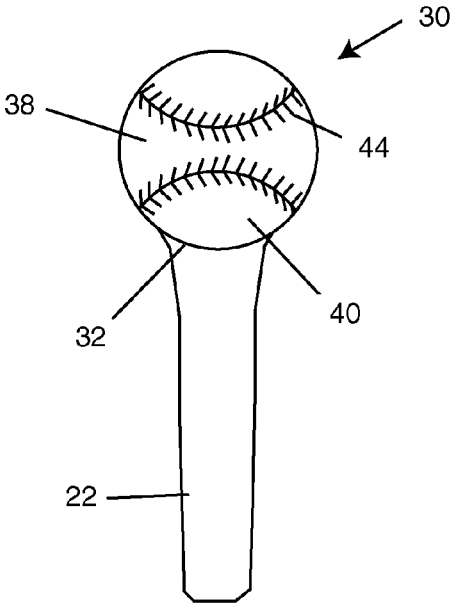
FIG. 13 is a perspective front view of a swing trainer embodiment illustrated in FIG. 12 further illustrating a cover hole in the cover.
Figure 14:
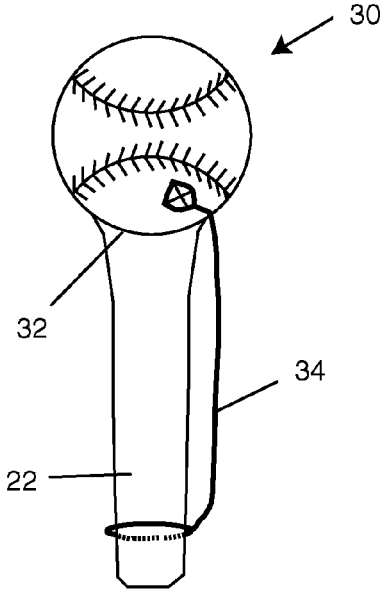
FIG. 14 is a perspective front view of a swing trainer embodiment illustrated in FIG. 13 further illustrating a safety anchor attached to the cover and the sheath.

A horizontal cover member 38 and a vertical cover member 40 are illustrated throughout the drawings but are specifically called out in FIGS. 5, 12, 13.

Figure 11:
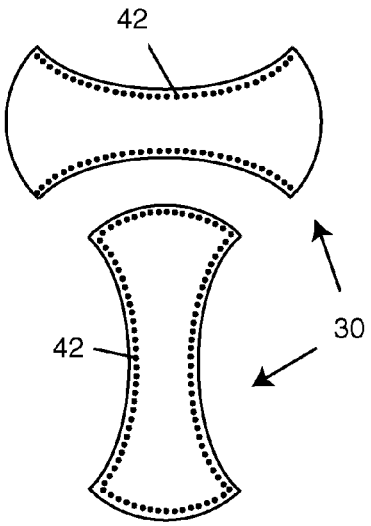
FIG. 11 is a perspective front view of a swing trainer embodiment illustrating seam holes in the cover.

A seam hole 42 is illustrated throughout the drawings but is specifically called out in FIG. 11.

A seam 44 is illustrated throughout the drawings but is specifically called out in FIGS. 12, 13, 17, 20, 21.

The cover 30, in one embodiment, is fabricated by creating a horizontal cover member 38 and a vertical cover member 40. The cover 30 is fabricated from durable materials such as leather, synthetic leather, or any other durable material suitable for withstanding an impact from a bat or other impact causing object.

The cover 30 can be made in a variety of colors, but the current embodiments use white for golf balls, baseballs, and softballs, or yellow for softballs and tennis balls. The size of the cover 30 is dependent on the size of the core end 24 of the sheath 22. This dependency comes from the fact that the cover 30 attaches to the core end 24 of the sheath 22.

The size of the cover 30 will vary in size depending on the size of the core end 24 of the sheath 22. For example, if the core end 24 is the size of a golf ball, the cover 30 will be smaller than if the core end 24 is the size of a baseball, etc.

There are many ways to attach the cover 30 to the core end 24 of the sheath 22. In one embodiment a cover 30 is fabricated to resemble a structure like a shower cap. The cover 30 stretches over the core end 24 of the sheath 22, and has a holding member such as an elastic or draw string type mechanism for securing the cover 30 to the core end 24 of the sheath 22.

In another embodiment, the cover 30 can be fabricated to look like a fuzzy tennis ball. In this case, the tennis ball type cover 30 would be molded around the core end 24 of the sheath 22 or attached in a variety of ways.

In another embodiment, a cover 30 is created by using a pattern similar to a baseball or softball cover. It is known in the art that baseball and softball cover 30 patterns have a horizontal cover member 38 and a vertical cover member 40 for attaching to a cork or rubber core.

The horizontal cover member 38 and vertical cover member 40 both have at least one seam hole 42. One function of the seam hole 42 is to connect or sew the horizontal cover member 38 and vertical cover member 40 together using a seam 44.

In some cases the seam 44 is fabricated from durable string or thread. This string or thread can be treated to make the seam 44 slick for reducing the friction when a bat or impact causing object hits the seam 44. The seam 44 can be a variety of colors but in one embodiment the seam 44 is red in color to simulate the look of a regulation baseball or softball. However, in some cases, baseballs and softballs use a blue seam 44 or a variety of other colors.

Figure 4A:
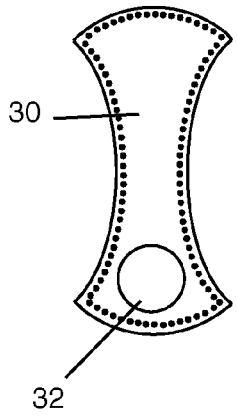
FIG. 4A is a perspective front view of a swing trainer embodiment illustrating a cover hole in the cover.
Figure 4B:
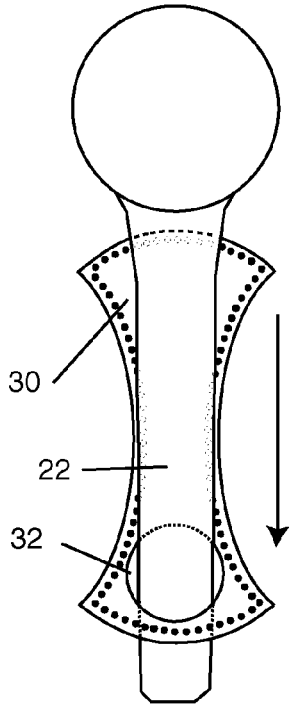
FIG. 4B is a perspective front view of a swing trainer embodiment illustrating how the sheath inserts through the cover hole of the cover.

In another embodiment, the vertical cover member 40 includes a cover hole 32 cut out of the vertical cover member 40. As illustrated in FIG. 4B, this cover hole 32 allows the protective end 26 of the sheath 22 to slide through the cover hole 32 so the cover 30 can be attached to the core end 24 of the sheath 22. In this case, the cover 30 can attach to the core end 24 of the sheath 22 without being hindered by the protective end 26 of the sheath 22.

Once the vertical cover member 40 is at the core end 24 of the sheath 22, the vertical cover member 40 and the horizontal cover member 38 are wrapped around the core end 24 of the sheath 22. Once wrapped together, a seam 44 is threaded through a seam hole 42 in the vertical cover member 40 and then through a seam hole 42 in the horizontal cover member 38. This process is repeated until the vertical cover member 40 and the horizontal cover member 38 is sewn together and the cover is securely attached to the core end 24 of the sheath 22.

Once the cover 30 is attached to the core end 24 of the sheath 22, a name, logo, or other writings can be printed on the cover 30. This writing can be used for branding purposes or to make the cover look more like a regulation ball.

A safety anchor 34 is illustrated throughout the drawings but is specifically called out in FIGS. 3, 7, 8, 9, 10, 14, 21.

Figure 8:
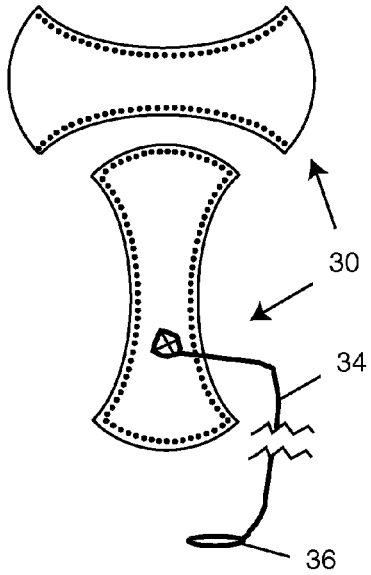
FIG. 8 is a perspective front view of a swing trainer embodiment illustrating a cover with an attached safety anchor having a safety anchor loop.
Figure 9:
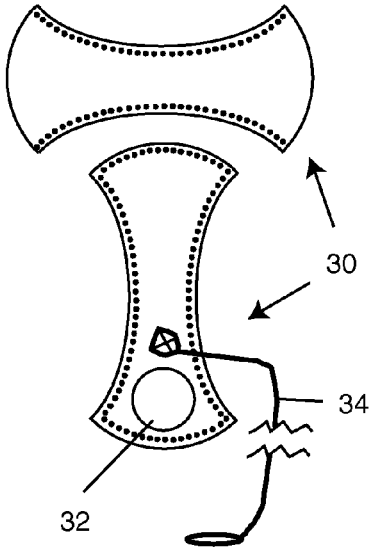
FIG. 9 is a perspective front view of a swing trainer embodiment illustrating a cover with a cover hole and an attached safety anchor.
Figure 10:
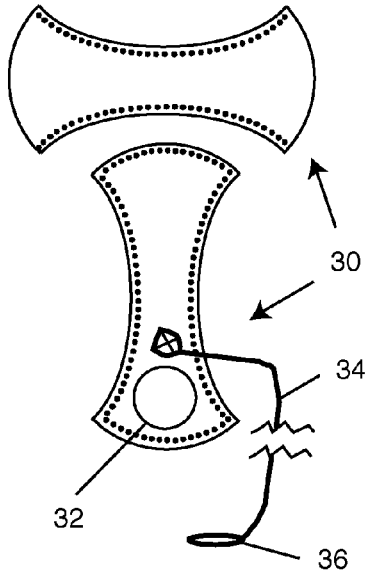
FIG. 10 is a perspective front view of a swing trainer embodiment illustrating a cover hole in the cover with an attached safety anchor having a safety anchor loop.

A safety anchor loop 36 is illustrated throughout the drawings but is specifically called out in FIGS. 8, 10.

In some cases, the impact of a bat or other impact causing object can weaken and break the structure of the stem 46. This breakage may cause a hazard if the sheath 22 and stem 46 fly off and hit a bystander. To help prevent this from happening, a safety anchor 34 can be fabricated to attach to the impact section and non-impact section of the swing trainer 20. The impact section can include the core end 24 of the sheath 22 while the non-impact section can include the stem 46, the handle 54, or a person's hand or arm that is holding the swing trainer 20.

In one embodiment, the safety anchor 34 is made of a nylon strap and is of the same color as the sheath 22. This allows the safety anchor 34 to visually blend in with the sheath 22. This type of material can be made of high tensile strength for restraining the flight of the sheath 22 or stem 46 if ever separated from the swing trainer 20.

The safety anchor 34 measures about 9" in length, has a width of approximately 0.625", and has a safety anchor loop 36 that attaches to the stem 46. This attachment point, in one case, can be just below the protective end 26 of the sheath 22.

The safety anchor 34 can be attached to the cover by inserting the safety anchor 34 through the cover hole 32 in the cover 30. The safety anchor 34 can be located on the inside of the cover 30 closest to the surface of the sheath 22. This allows the safety anchor 34 to blend in with the cover 30. The safety anchor 34 can then be attached to the cover 30 by sewing the safety anchor 34 to the cover 30. It is preferable to use a thread color that matches the color of the cover 30 of the swing trainer 20 so the thread blends in with the cover 30.

The safety anchor loop 36 can be attached at several different locations on the swing trainer 20. The safety anchor loop 36 can be attached to the sheath 22, to the stem 46, to the stem cover 48, to the handle 54, or to any other place fit for anchoring the sheath 22. The attachment location should be located at a place that will remain secure, if for some reason, the sheath 22 or stem 46 becomes dislodged from the swing trainer 20.

The safety anchor loop 36 can be fabricated by creating a loop in the safety anchor 34 and then attaching the loop together with thread, glue, or any other securing method. The safety anchor loop 36 needs to be of a predetermined size for securing the safety anchor loop 36 to the location point of the swing trainer 20.

There are many other ways to create the safety anchor 34 and safety anchor loop 36. Several material choices are available such as rope, cable, string, wire, nylon, or any other suitable anchoring material. Any color is suitable; however, it is preferred to be the color of the sheath 22 since this allows the safety anchor 34 to blend in with the sheath 22.

A stem 46 is illustrated throughout the drawings but is specifically called out in FIGS. 15A, 15B, 15C, 17, 20, 21, 25, 26.

Figure 25:
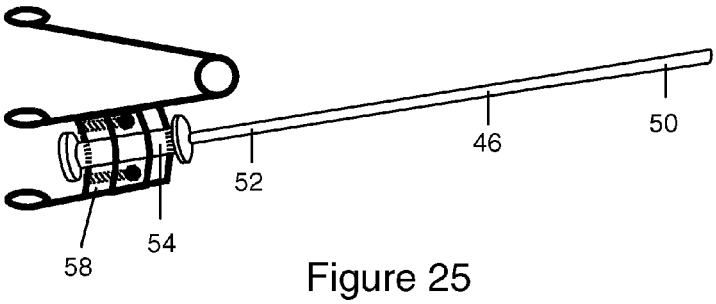
FIG. 25 is a perspective front view of a swing trainer embodiment illustrating a stem with a proximal end and a distal end. The distal end is attached to a handle and the handle is attached to a removable handle clamp.
Figure 26:
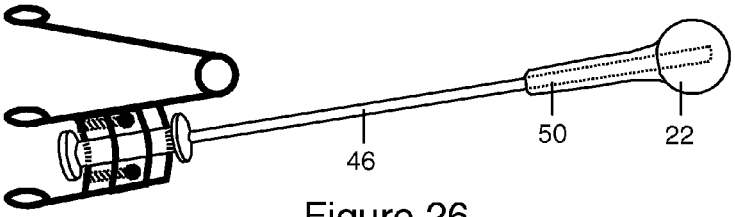
FIG. 26 is a perspective front view of a swing trainer embodiment illustrated in FIG. 25 further illustrating a sheath attached to the proximal end of the stem.

A proximal end 50 is illustrated throughout the drawings but is specifically called out in FIGS. 15A, 15B, 25.

A distal end 52 is illustrated throughout the drawings but is specifically called out in FIGS. 15A, 25.

The stem 46, in one embodiment, is fabricated from a 0.375" diameter fiberglass rod. The length can measure from 1" to 72" or more. In one of the preferred embodiments, the length is approximately 48". In this embodiment the color of the stem 46 is black to blend in with the sheath 22; however, any color is suitable.

Many materials can be used for the stem 46 as well. Solid fiberglass, tubular fiberglass, steel tubing, solid steel rod, aluminum, bamboo, spring steel, or any other type of material capable of supporting a sheath 22. Other diameters such as 0.250", 0.500", 1.00" can be used. Diameters as small as 0.0625 and as large as 6" are also possible. The stem's 46 shape can be round, square, triangular or any shape desired by the fabricator.

The stem 46 material should be flexible enough and/or strong enough to rebound back to its original shape after being hit by a bat or other impacting causing object. The stem 46 has a proximal end 50 and a distal end 52.

In one embodiment, the proximal end 50 of the stem 46 is inserted into the sheath 22 approximately 10.5" if measuring from the start of the protective end 26.

A handle 54 is illustrated throughout the drawings but is specifically called out in FIGS. 16, 17, 19, 20, 21, 22A, 22C, 25.

A handle anchor 56 is illustrated throughout the drawings but is specifically called out in FIGS. 17, 20, 21, 27.

Figure 21:
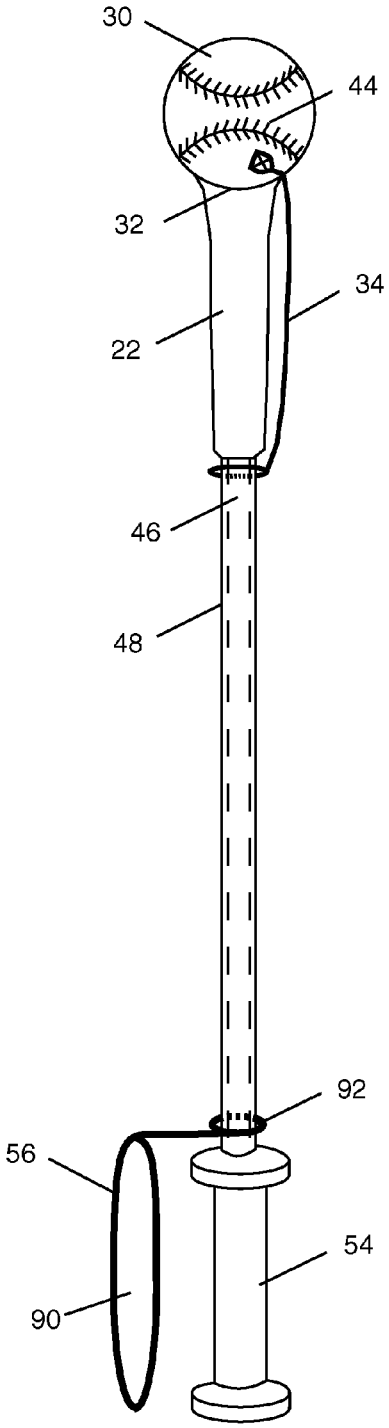
FIG. 21 is a perspective front view of a swing trainer embodiment illustrated in FIG. 20 further illustrating a safety anchor attached to the swing trainer.

A handle loop 90 and a mounting loop 92 are illustrated in FIG. 21.

In another embodiment, a handle 54 is attached to the distal end 52 of the stem 46. The handle 54 can be made by inserting the distal end 52 of the stem 46 approximately 3" to 10" into the stem 46 insertion opening in a mold. The mold has a fabricated cut out in the shape of a handle so the material poured into the mold will form in the shape of a handle. A skinned foam polyurethane material can be injected through a mold port in the mold. This allows the skinned foam polyurethane to fully surround the stem 46 inside the mold.

Once the stem 46 is surrounded by the skinned foam polyurethane, the skinned foam polyurethane produces a chemical reaction and begins to foam and grow in the mold and then bonds to the stem 46. In addition, skinned foam polyurethane is also known to have good gluing properties and acts as an adhesive for bonding the handle 54 to the stem 46.

Figure 22A:
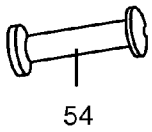
FIG. 22A is a perspective front view of a swing trainer embodiment illustrating a handle.
Figure 22B:
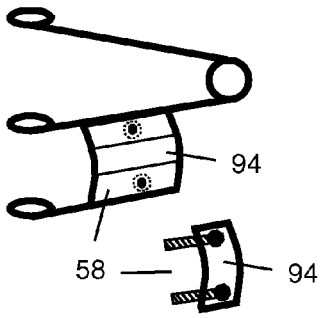
FIG. 22B is a perspective front view of a swing trainer embodiment illustrating a removable handle clamp.
Figure 22C:
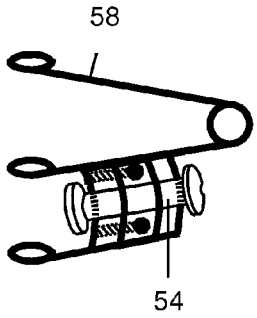
FIG. 22C is a perspective front view of a swing trainer embodiment illustrating an assembly of a removable handle clamp and a handle.

In one embodiment, the handle 54 is designed for a person or removable handle clamp 58, see FIG. 22B, to hold the handle 54. The handle 54 is usually made of soft material to help absorb the impact after a batter or player hits the swing trainer 20.

Other materials that can be used to make the handle 54 include rubber, foam, plastic, or any type of material satisfactory to the holder. The handle can be molded in a variety of colors such as red, black, blue, or any color satisfactory to the fabricator.

In another embodiment, a handle anchor 56 is associated with the handle 54 to act as a safety member in case the holder loses grip of the handle 54. In one embodiment, the handle anchor 56, is made of 1" black elastic strap. The handle anchor 56 can include a handle loop 90 for sliding your hand through, or for attaching the handle loop 90 to a removable handle clamp 58. The handle loop 90 measures approximately 5" in diameter.

In addition, the handle anchor 56 can include a mounting loop 92. This mounting loop 92 is approximately 0.750" in diameter and stretches to attach to the handle 54, stem 46, or stem cover 48. The handle anchor 56 can be made in black or any other preferred color.

A stem cover 48 is illustrated throughout the drawings but is specifically called out in FIGS. 18, 19, 20, 21.

The stem cover 48, in one embodiment, is fabricated out of black plastic tubing. The inside diameter of the stem cover 48 is just large enough for sliding over the stem 46. The outside diameter is about 0.125" larger than the inside diameter making the wall of the stem cover 48 approximately 0.0625" or greater. The size of the stem cover 48 can vary depending on personal preference.

The purpose of the stem cover 48 is to act as an additional safety mechanism in case the stem 46 breaks. The length of the stem cover 48 should be just long enough to have about 1" sticking into the beginning of the sheath 22 and about 1" sticking into the beginning of the handle 54. This will allow the rest of the sheath 22 and handle 56 to be securely bonded to the stem 46. However, if the sheath 22 breaks, the stem cover 48 will still be attached to the sheath 22 and the handle 54 keeping the sheath 22 attached to the swing trainer 20.

Another purpose of the stem cover 48 is to act as a cover for the stem 46. For example, if the stem is made of fiberglass and you come in contact with it, the fiberglass can sometimes stick into your hands and cause itching. In this case, the stem cover 48 acts as a protective cover for the stem 46.

In addition, the stem cover 48 can be fabricated in many different colors so you can create variety of different looks for the swing trainer 20.

A removable handle clamp 58 is illustrated throughout the drawings but is specifically called out in FIGS. 22B, 22C, 23, and 24.

Figure 23:
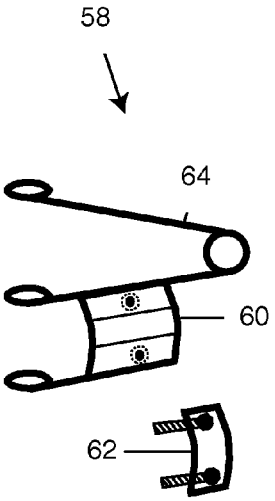
FIG. 23 is a perspective front view of a swing trainer embodiment illustrating members of a removable handle clamp. The members include a holding member, a latch member, and a structure member.
Figure 24:
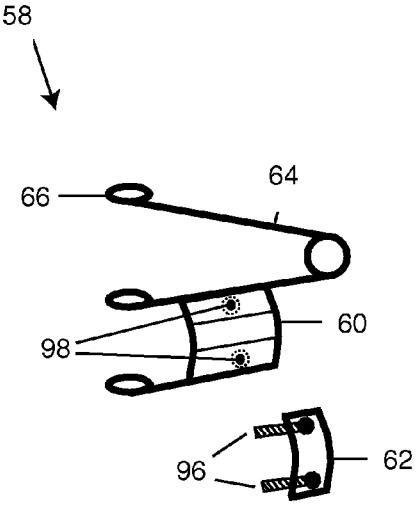
FIG. 24 is a perspective front view of a swing trainer embodiment illustrated in FIG. 23 further illustrating a connection member.

A holding member 60, a latch member 62, and a structure member 64 are illustrated throughout the drawings but are specifically called out in FIGS. 23, and 24.

Figure 28:
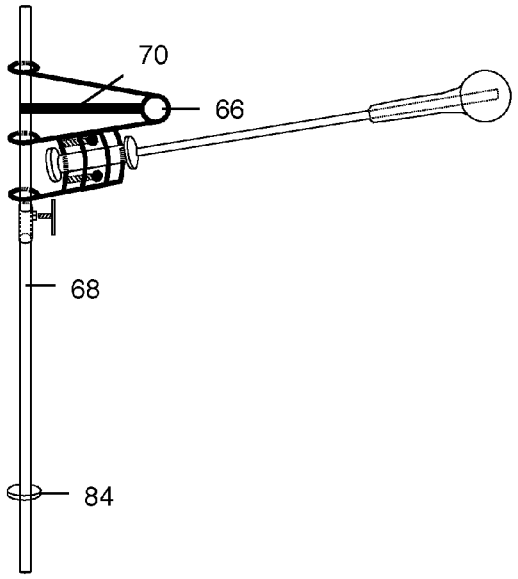
FIG. 28 is a perspective front view of a swing trainer embodiment illustrated in FIG. 27 further illustrating a resistance member, a connection member, and a barricade.

A connection member 66 is illustrated throughout the drawings but is specifically called out in FIGS. 24 and 28.

A cradle member 94 is illustrated specifically in FIG. 22B.

A threaded knob 96 and threaded nut 98 are illustrated throughout the drawings but are specifically called out in FIG. 24.

The removable handle clamp 22, in one embodiment, includes a structure member 64, a connection member 66, a holding member 60, and a latch member 62.

The structure member 64 includes four wire loop connection members 66 and is formed out of steel wire approximately 0.250" in diameter and can be black or any other color.

Figure 29:
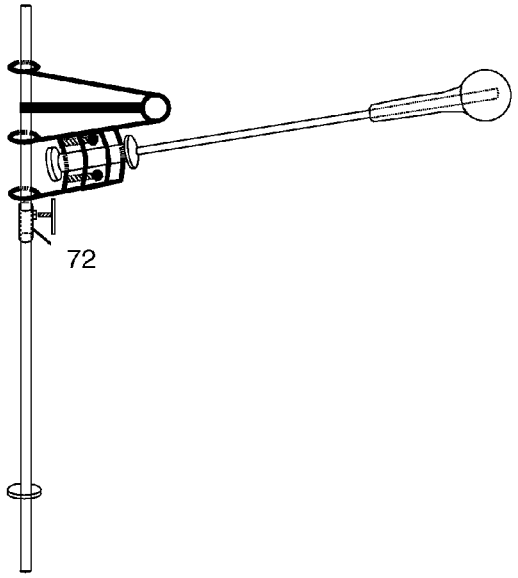
FIG. 29 is a perspective front view of a swing trainer embodiment illustrated in FIG. 28 further illustrating a height member.
Figure 30:
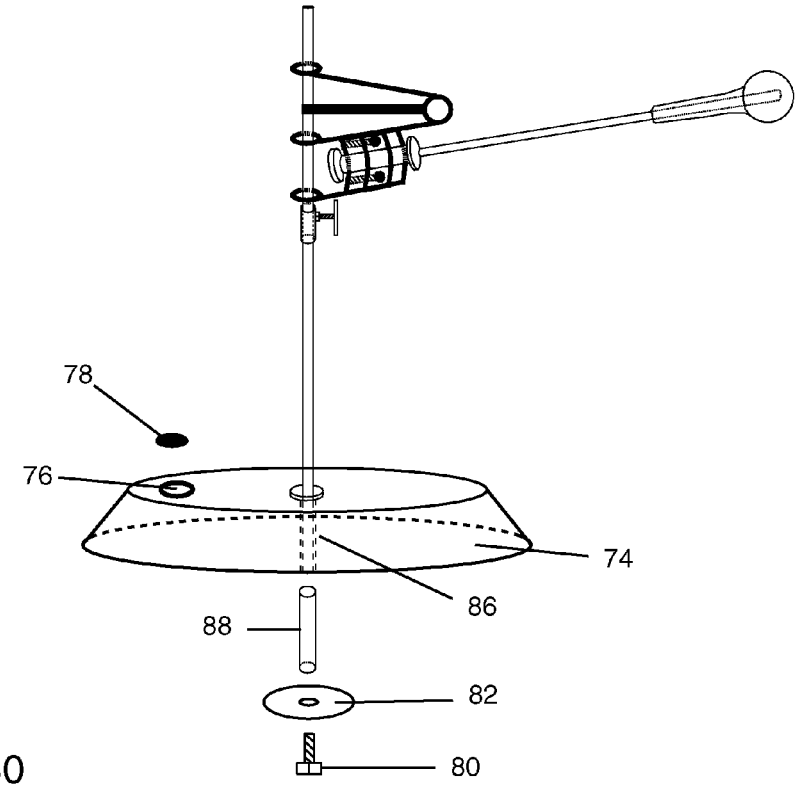
FIG. 30 is a perspective front view of a swing trainer embodiment illustrated in FIG. 29 further illustrating a base, base accessories, and mounting members for attaching the base to the support member.

The loops measure approximately 0.875" in diameter. Three connection members 66 attach to the support member 68 and allow the removable handle clamp 22 to rotate around the support member 68 while one connection member 66 attaches to a resistance member 70. The resistance member 70, as seen in FIGS. 28, 29, and 30, stretches around the support member 68 when the removable handle clamp 22 rotates. After the resistance member 70 reaches its unstretchable point, the resistance member 70 returns the removable handle clamp 22 back to its original position.

In one embodiment, the holding member 60 is designed to mount the handle 54 or stem 46 to the removable handle clamp 58, while the latch member 62 is designed to secure the handle 54 or stem 46 to the holding member 60. The latch member 62 is designed to quickly connect and disconnect the handle 54 or stem 46 from the holding member 60.

In some embodiments, the holding member 60 is fabricated by creating a cradle member 94 for holding the handle 54 or the stem 46. Holes are fabricated in the holding member 60 and threaded nuts 98 are welded to the open holes to provide a threaded hole. This provides the means for allowing the latch member 62 to quickly fasten to the holding member 60.

The latch member 62 can be fabricated by creating a cradle member 94 and fabricating holes in the latch member 62. These holes line up with the holes in the holding member 60. This allows threaded knobs 96 to insert through the holes in the latch member 62 and screw into the threaded nuts 98 on the holding member 60.

The purpose of the holding member 60 is to hold the handle 54 or the stem 46 while the latch member 62 tightens up and squeezes the handle 54 or stem 46 against the holding member 60. Once the handle 54 or stem 46 is secure, the user use the swing trainer 20 and then unscrew the threaded knob 96 and release the handle 54 or the stem 46 from the holding member 60.

Other embodiments of the removable handle clamp 58 includes a holding member 60 fabricated from a metal tube. The metal tube would allow the handle 54 to slide into the metal tube while a collar tightens the metal tube around the handle 54 and secures the handle in place. To release the handle 54 from the metal tube, the collar would be twisted in the opposite direction.

In yet another embodiment, a removable handle clamp 58 can be attached to a handle 54. The handle 54 can be attached to the distal end 52 of the stem 46. The proximal end of the stem 45 can attach to the sheath 22.

In yet another embodiment, the handle 54 can have a handle anchor 56. The handle anchor 56 is attached to the handle 54 and the support member 68 or to the handle 54 and the removable handle clamp 58. Fabrication of the above embodiments has been addressed earlier in the previous sections.

Figure 27:
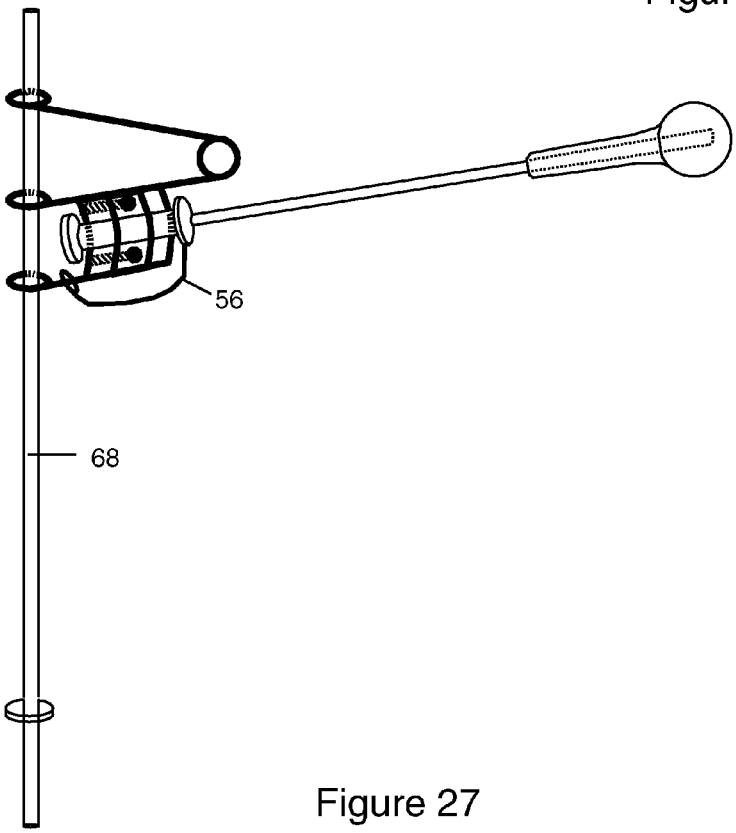
FIG. 27 is a perspective front view of a swing trainer embodiment illustrated in FIG. 26 further illustrating a handle anchor and support member.

A support member 68 is illustrated throughout the drawings but is specifically called out in FIGS. 27 and 28.

A barricade 84 is illustrated specifically FIG. 28.

The support member 68, in one embodiment, is fabricated by cutting a steel tube or solid steel rod approximately 48" in length. The outside diameter of the tube measures approximately 0.750". Both length and diameter of the steel tube can be changed based on preference.

For example, to make the product look more valuable, a larger diameter tube might be used. To make the support member 68 taller additional length can be added. To make the support member 68 smaller, you can reduce the length. Some reasons for doing this would be cost, portability, function, etc. Other materials such as aluminum, wood, bamboo, or other rigid types of materials can be used as well.

A barricade 84 acts as a stopper for the support member 68. This barricade 84 allows the support member 68 to be inserted into the base at a predetermined distance. The barricade 84 also provides a compression means for the barricade 84 to compress against the top surface of the base 74. This occurs when a securement member 80 is screwed into the support member 68 and tightened up against the base 74.

The barricade can be made of a metal washer measuring about 2" in diameter with an inner hole measuring approximately 0.775" in diameter. The inner hole of the washer slides over the 0.750" tubular steel support member 68. The washer and the tubular steel support member 68 are then welded together approximately 4" from the distal end of the tubular steel support member 68.

Once the barricade 84 is attached to the support member 68, the support member 68 is threaded at its distal end. Threading the support member 68 allows the securement member 80 to screw into the support member 68 and tighten. In addition, a finishing cap can be placed on the proximal end of the support member 68 to make the support member 68 appear more finished.

A height member 72 is illustrated specifically FIG. 29.

The height member 72, in one embodiment, is fabricated by molding a plastic tube with an inside diameter of approximately 0.775". The outside diameter measures approximately 1.25". The length is approximately 2.25". This plastic tube is black in color and has a threaded portion running perpendicular and through the surface to the inside diameter. A threaded knob screws into the threaded nut and tightens up against the support member 68.

In another embodiment, the height member 72 is fabricated out of steel, aluminum, wood, or any other type of tubular material. The color can be any preferred color. The locking mechanism for adjustably locking the height member 72 to the support member 68 can also be made with a push pin, bolt, tape, or any other type of mechanism that can hold the height member 72 at certain heights in relation to the support member 68.

In another embodiment, the height member 72 can be as simple as a bolt or pin pushed through a hole in the support member 68.

Once the height member 72 is fabricated, the height member 72 slides over the outside diameter of the support member 68. The adjustable locking device is tightened and loosened depending on where you want the height of the removable handle clamp 58 to be located. The connection member 66 of the removable handle clamp 58 rests and spins around the height member 72. The height member 72 allows the user to adjust the height of the removable handle clamp 58 to simulate various heights for the cover 30.

A resistance member 70 is illustrated throughout the drawings but is specifically called out in FIG. 28.

As discussed previously, the resistance member 70 attaches to the connection member 66 of the removable handle clamp 58 and to the support member 68. The resistance member 70 securely attaches to the support member 68 so when the handle clamp 58 rotates, the distal end of the resistance member 70 rotates as well; however, the proximal end of the resistance member 70 is attached to the support member 68 and does not rotate. This causes the resistance member 70 to stretch. Once the resistance member 70 reaches its unstretchable point, the resistance member 70 begins to retract and bring the removable handle clamp 58 back to its original position.

In one embodiment, the resistance member 70 is a rubber band 7" in diameter and 0.625" in width. If higher resistance is desired, multiple rubber bands can be added.

In other embodiments, the resistance member 70 is fabricated by cutting out pieces from an inner tube tire, by using surgical tubing, bungee cord, or any other type of stretchable material. A shock or spring could also be used as well.

A base 74, a base mount member 86, a base opening 76, a base seal 78, a base support member 88, a flange 82, and a securement member 80 are specifically illustrated in FIG. 30.

In one embodiment, a base 74 is fabricated as a container to hold weighted materials such as water, sand, concrete, or the like. One way to fabricate this weight-filled base 74 is to blow mold the base 74. A blow molded base 74 has a solid perimeter, but is hollow inside, for allowing various amounts of weight to be added for stabilizing the base 74. The benefit of this type of weight-filled base 74 is that it's inexpensive and light-weight for shipping purposes. In addition, the blow molded base 74 can be filled with weight that is easily acquired at home.

The base 74 measures approximately 18" in diameter and 5" in height. The blow molded base 74 has an opening running through the center of the base 74 called a base mount member 86. This base mount member 86 allows the support member 68 to insert through the base 74. The support member 68 inserts until such time as the barricade 84 rests on the upper surface of the base 74.

In one embodiment, the blow molded base 74 includes a reinforcement structure called a base support member 88. The base support member 88 is pressed or slid into the base mount member 86 to reinforce the structure of the blow molded base 74.

Once the support member 68 is inserted through the base 74, a securement member slides through a flange 82 and threads into the threaded portion of the support member 68. This allows the securement member 80 and flange 82 to tighten and press up against the under-side of the base while the barricade tightens up against the upper side of the base.

If needed additional rubber gripping type washers can be added underneath the barricade 84 and on top of the flange 82 so when tightening the securement member 80, the rubber washers grip the top and bottom base 74 surfaces and keep the support member 68 from spinning.

Also a lock washer can be added between the flange 82 and the securement member 80 to keep the securement member 80 from coming loose.

To further define fabricating the blow molded base 74, a base opening 76 measures about 2.75" in diameter and can be fabricated by creating a hole in the top surface of the blow molded base 74. This base opening 76 is used for adding water, sand, gravel, etc. into the inner container of the blow molded base 74. Once filled, a base seal 78 is attached into the hole of the base opening 76.

The base seal 78, in one embodiment, is simply a plug or cap that can snap into the base opening 76. Other embodiments of the base cap can be fabricated by using a cork or any other suitable plug type material.

The base 48, in another embodiment, can be fabricated out of wood, steel, concrete or any suitable material strong enough to support the support member 68. A connection means is also fabricated for connecting the base 48 to the support member 68. These base 74 configurations are well known in the art.

The base 48, in yet another embodiment, is fabricated by making a stake or tube that can be driven or cemented into a surface. The stake or tube is disposed below the surface and provides a connection means for connecting the support member 68 to the base 48. In this embodiment, the support member 68 inserts into a stake or tube in the surface while the barricade 84 only allows the support member 68 to insert at a predetermined distance. In another embodiment, the stake can protrude out of the surface. This allows the support member 68 to connect externally to the protruding base 86.

PREFERRED EMBODIMENTS

Operation

FIGS. 1A-33 illustrate several preferred embodiments of a new swing trainer 20.

The new swing trainer 20 can be used in at least two different applications.

Figure 31:
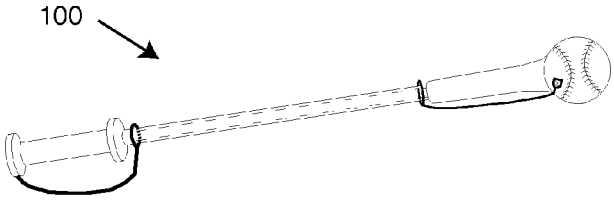
FIG. 31 is a perspective front assembly view of a swing trainer sub-assembly batting stick embodiment used by two people.

In one application, FIG. 31 shows a swing trainer 20 with a sub-assembly batting stick 100. In this application two people are required for swing training. One person to hold the batting stick 100 and second person to hit the batting stick 100.

Figure 32:
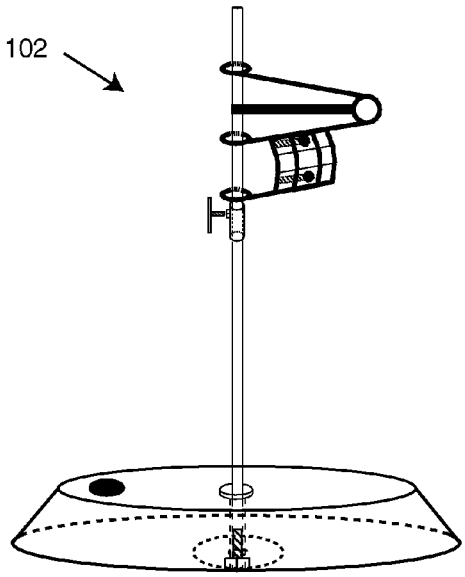
FIG. 32 is a perspective front assembly view of a swing trainer sub-assembly solo stand embodiment used by one person to hold the batting stick.

In another application, FIG. 32 shows a swing trainer 20 with a sub-assembly solo stand 102. The solo stand 102 eliminates the need for a person to hold the batting stick 100. This solo stand 102 allows one person to take hitting practice alone.

Figure 33:
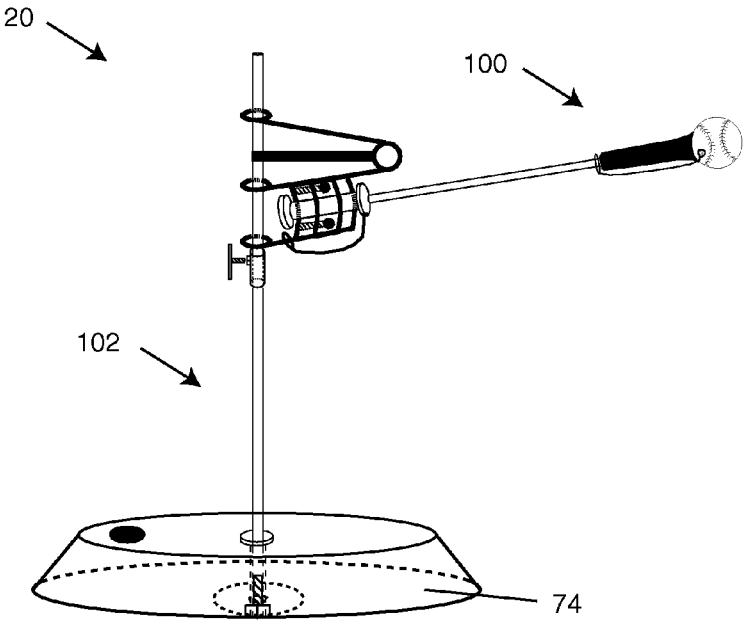
FIG. 33 is a perspective front assembly view of a swing trainer embodiment.

FIG. 33 shows a fully assembled swing trainer 20 with the batting stick 100 attached to the solo stand 102.

In FIG. 31 there is illustrated a swing trainer 20 with a sub-assembly batting stick 100. Other embodiments showing just the sub-assembly of the batting stick 100 can be found in FIGS. 16, 17, 19, 20, and 21.

To use the swing trainer 20 in the sub-assembly batting stick 100 embodiment, one person, herein after referred to as the "holder", slides his or her hand through the handle loop 90 as shown in FIG. 21. The holder then holds the batting stick 100 by the handle 54. The holder then positions the batting stick 100 at an approximate horizontal angle as shown in FIG. 31. The holder raises or lowers the batting stick 100 to position the cover 30 and sheath 22 in the hitting zone of the player. Once in the hitting zone, the player hits the cover 30 and sheath 22, see FIG. 21. The holder then lets his arm rotate with the force of the batting stick 100 until the holder brings the batting stick 100 to a stop. The holder then repositions the batting stick 100 back in the player's hitting zone to repeat the same process.

If for some reason the holder lost grip of the handle 54, the handle anchor 56 would keep the batting stick 100 safely anchored to the holder's hand. See FIG. 21. Also, if for some reason the cover 30 or sheath 22 broke off from the batting stick 100 the safety anchor 34 would keep the cover 30 and sheath 22 safely anchored to the batting stick 100. In addition, if the stem 46 broke, the stem cover 48 would keep the cover 30 and sheath 22 safely anchored to the batting stick 100.

There are many benefits of using the batting stick 100 by itself. One benefit is the batting stick 100 can be easily transported to and from the playing field or court. When in this embodiment, the batting stick 100 is very portable.

However, there are many instances when a friend can't be found and you want to work on your hitting skills. FIG. 32 illustrates a solo stand 102. The solo stand 102 takes the place of a human holder. This allows you to work on your hitting alone.

Referring to FIGS. 22A-24, simply loosen the threaded knobs 96 on the latch member 62 and place the handle 54 of the batting stick 100 between the cradle member 94 and the latch member 62. Secure the handle 54 in the removable handle clamp 58 by tightening the threaded knobs. This squeezes the handle 54 between the latch member 62 and the holding member 60. This compression secures the handle 54 in the removable handle clamp 58. To use the batting stick 100 alone, simply reverse the process and release the batting stick 100 from the removable handle clamp 58.

Once the handle 54 is secure in the removable handle clamp 58, attach the handle anchor 56 to the removable handle clamp 58. The safety anchor 56 will keep the batting stick 100 anchored to the swing trainer 20 in case the batting stick 100 accidentally came loose from the removable handle clamp 58.

After the batting stick 100 is assembled to the removable handle clamp 58, slide the height member 72 over the support member 68, see FIG. 30. Set the height member 72 at the desired height and tighten the knob of the height member 72 to secure the height member 72 to the support member 68.

Once secure, slide the three connection members 66 of the removable handle clamp 58 over the support member 68. Let lower connection member 66 rest on the height member 72. If the batting stick is not positioned at the desired height, simply loosen the height member 72, reposition, and re-secure the height member 72 to the support member 68.

Now, securely attach the resistance member 70 to the fourth connection member 68 of the removable handle clamp. This allows the swing trainer 20 to return the hit batting stick 100 back to its original position.

Next, slide the support member 68 through the base mount member 86 in the base 74 until the barricade 84 on the support member 68 rests on the top of the base 74, see FIGS. 28-30. Insert the base support member 88 through the base mount member 86 of the base 74 and over the support member 68.

Slide the securement member 80 through the center hole of the flange 82. Then screw the securement member 80 into the threaded end of the support member 68 and tighten. This tightening operation will squeeze the base 74 between the barricade 84 and the flange 82 causing the support member 68 to be secured in a sturdy and approximate vertical position.

Now, add water, sand, concrete, or any other material heavy enough to support the swing trainer 20 through the base opening 76 and attach the base seal 78, see FIG. 30.

The final assembled swing trainer 20 with the sub-assembly batting stick 100 and solo stand 102 is illustrated in FIG. 33.

Once fully assembled, the hitter hits the batting stick 100 and the solo stand 102 allows the batting stick 100 to spin in a circle. Once the resistance member 70 winds tight enough around the support member 68, the batting stick returns to the original position and the hitter hits the batting stick again. If the hitter desires the batting stick to come back faster, additional resistance members 70 can be added.

In this embodiment, the hitter can choose to let the batting stick 100 come back to a complete stop or hit the batting stick as it moves toward the hitter. When the batter hits the moving batting stick it simulates a moving pitch. Because the resistance member 70 winds around the support member 68, the better the hitter hits the batting stick 100, the faster the batting stick 100 returns to be hit again.

The hitter can hit right handed or left handed. The hitter can set the height of the cover 30 and sheath 22 at the height desired by loosening the height member 72 and sliding the height member 72 up or down the support member 68. Once at the desired height, the hitter can secure the height member 72 in place by tightening the knob on the height member 72. See FIG. 29.

If the hitter wants to take the batting stick 100 sub-assembly to the ball field or court, the hitter simply loosens the threaded knobs 96 on the removable handle clamp 58 and removes the batting stick 100 from the solo stand 102 sub-assembly.

The swing trainer 20 can be used for baseball, softball, tennis, or any other sport that requires the skill of hitting.

In one embodiment, the core end 24 of the sheath 22 is the size of a golf ball. In this application, the hitter can work on hitting a much smaller ball to improve hand/eye coordination. This smaller ball helps the eye precisely focus on the target and in return develops a more precise swing.

SCOPE OF INVENTION

The present invention may be embodied in other specific forms without departing from its spirit or essential characteristics. The described embodiments are to be considered in all respects only as illustrative and not restrictive. Thus, the scope of the invention should be determined by the appended claims and their legal equivalents, rather than by the foregoing description. All changes which come within the meaning and range of equivalency of the claims are to be embraced within their scope.

I claim:

1. A swing trainer comprising:

a) a stem having a proximal end and a distal end;

b) a sheath having a bulbous core end and an elongated protective end, the proximal end of the stem extending through the elongated protective end and into a portion of the bulbous core end of the sheath;

c) a first piece of material vertically positioned over the bulbous core end of the sheath, the first piece of material including an opening, said opening received over the stem and the elongated protective end of the sheath, wherein the first piece of material is slidably moved towards the bulbous core end of the sheath thereby partially covering the bulbous core end;

d) a second piece of material horizontally positioned over the bulbous core end of the sheath, wherein the second piece of material is attached to the first piece of material to fully enclose the bulbous core end; and e) a means for supporting the swing trainer is attached to the distal end of the stem.

2. The swing trainer in claim 1, wherein the sheath is different in color than the first piece and second piece of material.

3. The swing trainer in claim 1, further comprising a safety anchor attached to the first piece of material.

4. The swing trainer in claim 3, wherein the safety anchor further comprises a safety anchor loop.

5. The swing trainer in claim 4, wherein the safety anchor loop connects with the proximal end of the stem.

6. The swing trainer in claim 1, further comprising a seam connecting the first piece of material and the second piece of material.

7. The swing trainer in claim 6, wherein when the first piece of material and the second piece of material are connected to form a ball cover over the bulbous core end of the sheath.

8. The swing trainer in claim 7, further comprising a safety anchor attached to the ball cover.

9. The swing trainer in claim 8, wherein the safety anchor further comprises a safety anchor loop.

10. The swing trainer in claim 9, wherein the safety anchor loop connects with the elongated protective end of the sheath.

11. The swing trainer in claim 1, further comprising a stem cover received over the stem.

12. The swing trainer in claim 1, wherein the stem is formed of glass-fiber.

13. The swing trainer in claim 1, further comprising a handle attached to the means for supporting the swing trainer.

14. The swing trainer in claim 13, wherein the distal end of the stem is connected to the means for supporting the swing trainer.

15. The swing trainer in claim 1, wherein the sheath is black in color.

16. The swing trainer in claim 1, wherein the stem is an elongated rod.

17. The swing trainer in claim 1, wherein the sheath is molded.

18. The swing trainer in claim 1, wherein the first piece of material includes a plurality of seam holes and the second piece of material includes a plurality of seam holes.

19. The swing trainer in claim 18, further comprising a seam connecting the plurality of seam holes in the first piece of material with the plurality of seam holes in the second piece of material.

20. The swing trainer in claim 19, wherein the first piece of material connected to the second piece of material form a ball cover over the bulbous core end of the sheath.

21. The swing trainer in claim 20, wherein the ball cover is a baseball cover.

22. A method of assembling a swing trainer comprising the steps of:

a) providing a stem having a proximal end and a distal end;

b) placing the proximal end of the stem in a mold;

c) injecting material in the mold and covering the proximal end of the stem;

d) molding a sheath having a bulbous core end and an elongated protective end;

e) positioning a first piece of material vertically over the bulbous core end of the sheath, the first piece of material including an opening;

f) receiving said stem and said elongated protective end of the sheath through the opening;

g) slidably moving the first piece of material towards the bulbous core end of the sheath and partially covering the bulbous core end;

h) positioning a second piece of material horizontally over the bulbous core end of the sheath, i) attaching the second piece of material to the first piece of material thereby fully enclosing the bulbous core end; and j) attaching a handle to the stem for supporting the swing trainer.

23. The method of assembling in claim 22, further comprising the step of coloring the sheath a different color than the first piece of material and the second piece of material.

24. The method of assembling in claim 22, further comprising the step of attaching a safety anchor to the vertical material.

25. The method of assembling in claim 24, wherein the safety anchor further comprises the step of forming a safety anchor loop.

26. The method of assembling in claim 25, further comprising the step of connecting the safety anchor loop with the proximal end of the stem.

27. A swing trainer comprising:

a) a stem having a proximal end and a distal end;

b) a formed member having a bulbous core end and an elongated protective end, the proximal end of the stem extending through the elongated protective end and into a portion of the bulbous core end of the formed member;

c) a first piece of material vertically positioned over the bulbous core end of the sheath, the first piece of material including an opening, said opening received over the stem and the elongated protective end of the sheath, wherein the first piece of material is slidably moved towards the bulbous core end of the sheath thereby partially covering the bulbous core end;

d) a second piece of material horizontally positioned over the bulbous core end of the sheath, wherein the second piece of material is attached to the first piece of material to fully enclose the bulbous core end; and e) a means for supporting the swing trainer is attached to the distal end of the stem.

28. The swing trainer in claim 27, further comprising a stem cover attached to the stem.

29. The swing trainer in claim 27, wherein the first piece of material and the second piece of material are connected to form a ball cover for the bulbous core end of said formed member.

30. The swing trainer in claim 29, further comprising a safety anchor attached to the ball cover.

31. The swing trainer in claim 30, further comprising a safety anchor loop associated with the safety anchor, the safety anchor loop is attached to the stem.

32. The swing trainer in claim 29, wherein the ball cover is a baseball cover.

33. The swing trainer in claim 27, further comprising a seam connecting the first piece of material to the second piece of material.

34. The swing trainer in claim 27, further comprising a handle anchor attached to the means for supporting the swing trainer.

35. A swing trainer comprising:

a) a stem having a proximal end and a distal end;

b) a formed member having a bulbous core end and an elongated protective end, the proximal end of the stem extending through the elongated protective end and into a portion of the bulbous core end of formed member;

c) a first piece of material vertically positioned over the bulbous core end of the sheath, the first piece of material including an opening, said opening received over the stem and the elongated protective end of the sheath, wherein the first piece of material is slidably moved towards the bulbous core end of the sheath thereby partially covering the bulbous core end;

d) a second piece of material horizontally positioned over the bulbous core end of the sheath, wherein the second piece of material is attached to the first piece of material to fully enclose the bulbous core end; and e) a handle attached to the distal end of the stem.

36. The swing trainer in claim 35, wherein the first piece of material and the second piece of material form a softball cover.

37. The swing trainer in claim 36, further comprising a safety anchor attached to the softball cover.

38. The swing trainer in claim 37, further comprising a safety anchor loop attached to the safety anchor.

39. The swing trainer in claim 35, further comprising a stem cover attached to the stem.

40. The swing trainer in claim 35, further comprising a handle anchor attached to the handle.

41. The swing trainer in claim 35, wherein the swing trainer further comprises:

a) a plurality of seam holes in the first piece of material;

b) a plurality of seam holes in the second piece of material; and c) a seam connecting the first piece of material to the second piece of material.

42. The swing trainer in claim 41, further comprising a handle anchor attached to the handle.

* * * * *